US005372662A

United States Patent [19]

Ganesan et al.

[11] Patent Number: 5,372,662

[45] Date of Patent: Dec. 13, 1994

[54] NICKEL-BASE ALLOY WITH SUPERIOR STRESS RUPTURE STRENGTH AND GRAIN SIZE CONTROL

[75] Inventors: Pasupathy Ganesan; Gaylord D. Smith, both of Huntington, W. Va.

[73] Assignee: Inco Alloys International, Inc., Huntington, W. Va.

[21] Appl. No.: 89,293

[22] Filed: Jul. 9, 1993

Related U.S. Application Data

[63] Continuation-in-part of Ser. No. 821,067, Jan. 16, 1992, abandoned.

[51] Int. Cl.[5] ..... C22C 19/05

[52] U.S. Cl. ..... 148/428; 148/442; 420/448

[58] Field of Search ..... 148/410, 419, 428, 442; 420/448

[56] References Cited

U.S. PATENT DOCUMENTS

| | | | |
|---|---|---|---|
| 3,859,060 | 1/1975 | Eiselstein | 420/448 |
| 4,474,733 | 10/1984 | Susukide et al. | 420/443 |
| 4,750,954 | 6/1988 | Smith et al. | 148/428 |
| 4,877,461 | 10/1989 | Smith et al. | 148/428 |
| 5,017,249 | 5/1991 | Smith et al. | 148/410 |

FOREIGN PATENT DOCUMENTS 0358211 3/1990 European Pat. Off. .

OTHER PUBLICATIONS

Development of a Ni-Base Heat Resistance Alloy for Gas Turbine Combustor, Nat'l Techanical Info. Service, 1983; vol. 19, No. 4 pp. 1-38.

"The Strengthening Effect of Tantalum in Nichel-Base Superalloys" *Superalloys* 1984 (Proceedings of the Fifth Int'l Symposium on Superalloys High Temperature Alloys Committee of the Metallurgical Society of AIME Oct. 7-11, 1984, Zhao-Yo Meng, Gen-Chang Sun, Min Lun Li, pp. 563-572.

*Primary Examiner*—Deborah Yee

*Attorney, Agent, or Firm*—Blake T. Biederman; Edward A. Steen

[57] ABSTRACT

A nickel-chromium-molybdenum-cobalt alloy has additions of tantalum and tungsten to provide superior stress rupture strength in the presence of grain size control agents, and has the following composition:

| | |
|---|---|
| Carbon | 0.04-0.15 |
| Iron | 0-8 |
| Chromium | 18-25 |
| Cobalt | 10-15 |
| Molybdenum | 5-9 |
| Aluminum | 0.7-1.5 |
| Tungsten | 0-5 |
| Titanium | 0-0.5 |
| Tantalum | 0.7-2.5 |
| Manganese | 0-1 |
| Silicon | 0.05-0.75 |
| Zirconium | 0.01-0.05 |
| Boron | 0-0.05 |
| Nickel + inevitable impurities | Balance |

14 Claims, 2 Drawing Sheets

NICKEL-BASE ALLOY WITH SUPERIOR STRESS RUPTURE STRENGTH AND GRAIN SIZE CONTROL

This is a continuation in part of Ser. No. 07/821,067, filed Jan. 16, 1992, now abandoned.

BACKGROUND OF THE INVENTION

The present invention is directed toward a nickel-base alloy with superior stress rupture strength and grain size control, as well as fatigue strength and corrosion resistance.

There exists in certain industries a need for alloys which can operate under severe conditions, notably high temperature and stress. This is true, for example, with respect to gas turbine components, where current specifications require a life of greater than 50 hours at stress rupture conditions of 871° C./98 MPa (1600° F./14.2 ksi). The manufacturers of such components have been setting increasingly higher standards, thus requiring materials suppliers to search for better alloys while maintaining a competitive price. The strict requirements for such an alloy require that it have isothermal and cyclic oxidation resistance, carburization resistance, good thermal stability after long term exposure at intermediate temperatures, good weldability, controlled grain size, and excellent stress rupture strength.

One alloy widely used for this purpose has been Inconel ® alloy 617. (Inconel is a trademark of the Inconel family of companies) Stress rupture (SRU) life for this alloy has typically been limited to approximately 47 hours at 927° C./62 MPa (1700° F./9 ksi). Indeed, SRU life can be extended to over 100 hours with increased annealing temperatures. However, this greater SRU life is obtained at the expense of cyclic fatigue strength, which is lowered by the increased grain size resulting from the higher anneal temperature.

It is an object of the present invention to provide a nickel-base alloy which exhibits improved stress rupture life, excellent fatigue strength through grain size control and has good corrosion resistance.

SUMMARY OF THE INVENTION

Accordingly, there is provided an alloy having the composition, in weight percent, of about:

| | |
|---|---|
| Carbon | 0.04–0.15 |
| Iron | 0–8 |
| Chromium | 18–25 |
| Cobalt | 10–15 |
| Molybdenum | 5–15.5 |
| Aluminum | 0.7–1.5 |
| Tungsten | 0–5 |
| Titanium | 0–0.5 |
| Tantalum | 0.7–2.5 |
| Manganese | 0–1 |
| Silicon | 0.05–0.75 |
| Zirconium | 0.01–0.05 |
| Boron | 0–0.01 |
| Nickel + inevitable impurities | balance |

It is understood that the nickel balance may contain incidental impurities.

It has been found that controlled additions of rungsten and tantalum impart an improvement in stress rupture life in the presence of grain size control agents. Therefore, final anneal temperatures of up to 2200° F. (1204° C.) can be used to give a stress rupture life of over 50 hours at 1600° F./14.2 ksi (871° C./98 MPa) and 700° F./9ksi (927° C./76 MPa). Meanwhile, grain size is kept at between ASTM 4 and 6.5 (89 and 38 μm respectively) to thereby maintain the fatigue strength necessary for operation under severe conditions.

DESCRIPTION OF PREFERRED EMBODIMENTS

Figure 1:
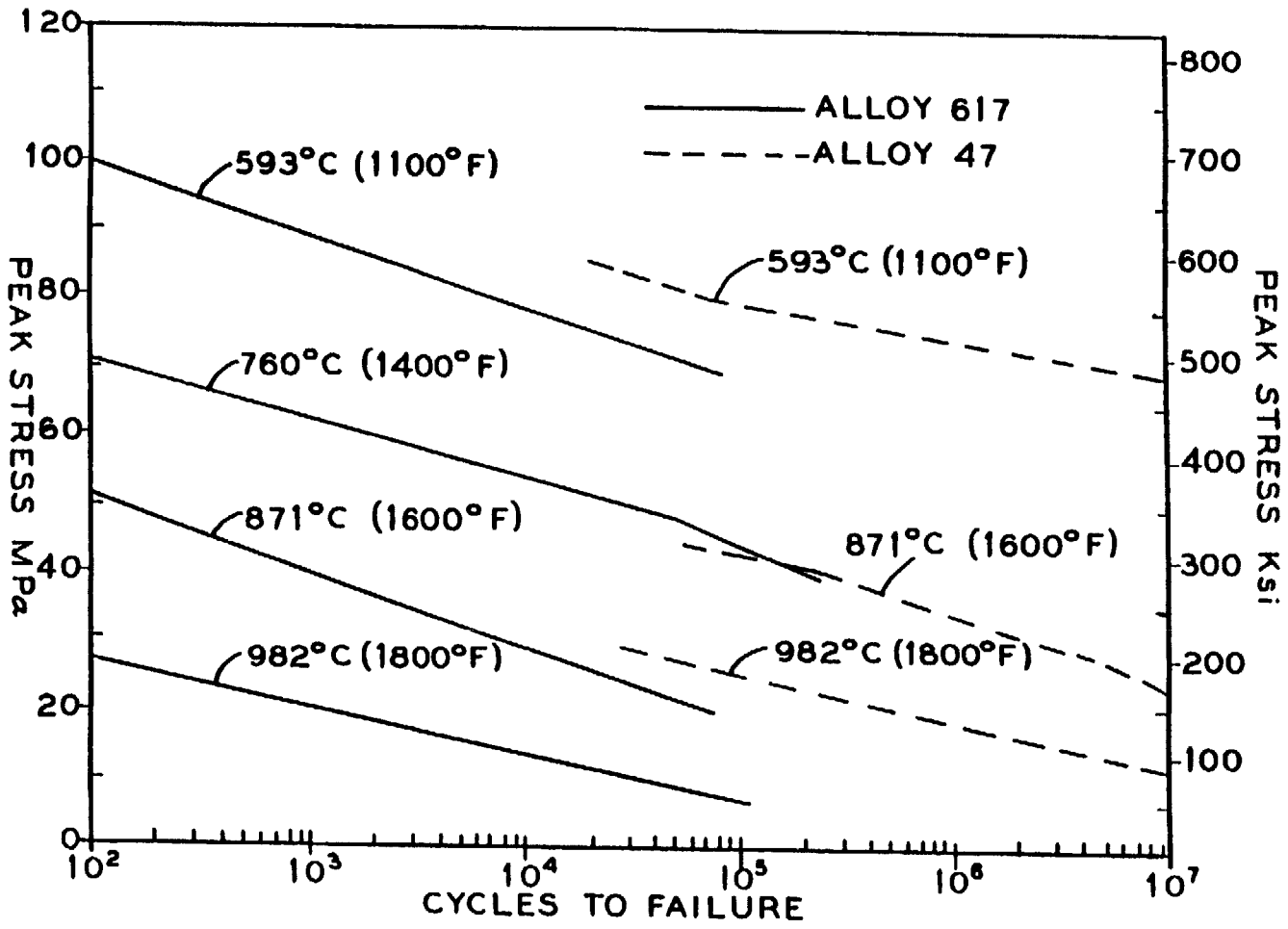
FIG. 1 compares tension/tension high-cycle fatigue to failure of alloy 617 to an alloy of the invention at various elevated temperatures.

Numerous tests were performed on samples of the claimed alloy, as well as comparison compositions of Inconel ® alloy 617, to demonstrate the efficacy of the claimed alloy. Compositions of the various samples are provided in Table 1.

| ALLOY | C | Fe | Si | Ni | Cr | Al | Ti | Co | Mo | Tn | W | Zr | B |
|---|---|---|---|---|---|---|---|---|---|---|---|---|---|
| 1 | 0.050 | 1.1 | 0.02 | 50.8 | 21.5 | 1.3 | 1.0 | 12.3 | 10.1 | 1.01 | — | 0.08 | |
| 2 | 0.046 | 1.0 | 0.13 | 50.2 | 21.9 | 1.3 | 1.0 | 12.4 | 10.2 | 1.01 | — | 0.09 | |
| 3 | 0.048 | 1.0 | 0.03 | 50.6 | 21.9 | 1.3 | 0.5 | 12.4 | 10.2 | 1.03 | — | 0.10 | |
| 4 | 0.050 | 1.0 | 0.13 | 50.4 | 21.9 | 1.3 | 0.5 | 12.5 | 10.3 | 1.02 | — | 0.11 | |
| 5 | 0.086 | 1.1 | 0.02 | 50.0 | 22.0 | 1.4 | 1.0 | 12.5 | 10.3 | 1.01 | — | 0.09 | |
| 6 | 0.084 | 1.0 | 0.13 | 50.0 | 21.9 | 1.3 | 1.0 | 12.4 | 10.3 | 1.00 | — | 0.09 | |
| 7 | 0.081 | 1.0 | 0.03 | 50.7 | 21.8 | 1.3 | 0.6 | 12.5 | 10.3 | 1.01 | — | 0.09 | |
| 8 | 0.094 | 1.0 | 0.13 | 50.5 | 21.9 | 1.3 | 0.5 | 12.5 | 10.3 | 1.01 | — | 0.09 | |
| 9 | 0.043 | 1.0 | 0.03 | 47.5 | 21.8 | 1.3 | 1.0 | 12.5 | 10.3 | 1.00 | 3.09 | 0.09 | |
| 10 | 0.080 | 1.0 | 0.02 | 47.3 | 21.8 | 1.3 | 1.0 | 12.4 | 10.3 | 0.99 | 3.32 | 0.09 | |
| 11 | 0.071 | 1.1 | 0.16 | 49.8 | 22.2 | 1.3 | 0.3 | 12.4 | 10.2 | 1.45 | — | 0.11 | |
| 12 | 0.103 | 1.0 | 0.16 | 49.7 | 22.3 | 1.3 | 0.3 | 12.5 | 10.2 | 1.49 | — | 0.11 | |
| 13 | 0.055 | 1.0 | 0.17 | 49.6 | 22.3 | 1.3 | 0.3 | 12.4 | 10.2 | 1.47 | — | 0.11 | |
| 14 | 0.055 | 1.0 | 0.18 | 49.7 | 22.3 | 13 | 0.3 | 12.4 | 10.2 | 1.47 | — | 0.11 | |
| 15 | 0.088 | 1.0 | 0.02 | 48.4 | 22.3 | 1.3 | 0.3 | 12.4 | 10.3 | 0.51 | 2.94 | 0.10 | |
| 16 | 0.085 | 1.0 | 0.02 | 46.2 | 22.6 | 1.3 | 0.3 | 12.4 | 10.2 | 0.54 | 4.84 | 0.09 | |
| 17 | 0.079 | 1.0 | 0.02 | 47.7 | 22.4 | 1.3 | 0.3 | 12.5 | 10.3 | 0.77 | 3.10 | 0.10 | |
| 18 | 0.083 | 1.1 | 0.02 | 45.9 | 22.5 | 1.3 | 0.3 | 12.5 | 10.2 | 0.79 | 4.80 | 0.09 | |
| 19 | 0.090 | 1.0 | 0.02 | 47.4 | 22.4 | 1.3 | 0.3 | 12.5 | 10.2 | 1.00 | 3.11 | 0.10 | |
| 20 | 0.087 | 1.0 | 0.02 | 45.S | 22.5 | 1.3 | 0.3 | 12.5 | 10.3 | 0.99 | 4.74 | 0.10 | |
| 21 | 0.087 | 1.1 | 0.02 | 48.2 | 22.5 | 0.6 | 0.1 | 12.5 | 10.1 | 1.05 | 3.13 | 0.09 | |

-continued

| ALLOY | C | Fe | Si | Ni | Cr | Al | Ti | Co | Mo | Tn | W | Zr | B |
|---|---|---|---|---|---|---|---|---|---|---|---|---|---|
| 22 | 0.106 | 1.0 | 0.02 | 46.4 | 22.4 | 0.6 | 0.1 | 12.5 | 10.2 | 1.04 | 4.93 | 0.09 | |
| 23 | 0.060 | 1.1 | 0.11 | 46.2 | 22.3 | 1.2 | 0.3 | 12.4 | 10.2 | 1.89 | 3.15 | 0.09 | |
| 24 | 0.048 | 1.0 | 0.12 | 44.4 | 22.3 | 1.3 | 0.3 | 12.4 | 10.2 | 1.94 | 4.83 | 0.09 | |
| 25 | 0.047 | 1.0 | 0.11 | 45.7 | 22.4 | 1.3 | 0.3 | 12.4 | 9.9 | 2.45 | 3.15 | 0.09 | |
| 26 | 0.058 | 1.1 | 0.11 | 43.7 | 22.2 | 1.3 | 0.3 | 12.4 | 10.3 | 2.50 | 4.86 | 0.11 | |
| 27 | 0.087 | 1.1 | 0.10 | 46.0 | 22.3 | 1.3 | 0.3 | 12.5 | 10.2 | 2.03 | 3.15 | 0.10 | |
| 28 | 0.087 | 1.1 | 0.11 | 44.3 | 22.2 | 1.3 | 0.3 | 12.4 | 10.2 | 1.96 | 4.85 | 0.10 | |
| 29 | 0.093 | 1.1 | 0.11 | 45.5 | 22.2 | 1.3 | 0.3 | 12.4 | 10.2 | 2.37 | 3.21 | 0.10 | |
| 30 | 0.101 | 1.1 | 0.12 | 43.9 | 22.3 | 1.3 | 0.3 | 12.5 | 10.0 | 2.46 | 4.82 | 0.10 | |
| 31 | 0.085 | 1.0 | 0.12 | 48.9 | 22.3 | 1.3 | 0.3 | 12.4 | 10.3 | 1.44 | 0.61 | 0.10 | |
| 32 | 0.089 | 1.1 | 0.11 | 48.7 | 22.3 | 1.3 | 0.3 | 12.4 | 10.2 | 1.91 | 0.21 | 0.11 | |
| 33 | 0.084 | 1.1 | 0.11 | 48.8 | 21.9 | 1.2 | 0.3 | 12.4 | 10.0 | 2.44 | 0.16 | 0.10 | |
| 34 | 0.083 | 1.1 | 0.12 | 52.1 | 22.1 | 1.3 | 0.3 | 12.5 | 10.3 | — | — | 0.04 | |
| 35 | 0.087 | 1.1 | 0.01 | 53.0 | 22.3 | 0.3 | 0.3 | 12.5 | 5.0 | 1.53 | 2.96 | 0.09 | |
| 36 | 0.081 | 1.1 | 0.01 | 51.0 | 22.3 | 0.3 | 0.3 | 12.5 | 7.0 | 1.48 | 3.14 | 0.08 | |
| 37 | 0.081 | 1.1 | 0.02 | 49.1 | 22.3 | 0.3 | 0.3 | 12.5 | 7.0 | 1.50 | 4.85 | 0.08 | |
| 38 | 0.081 | 1.1 | 0.02 | 49.8 | 22.1 | 0.3 | 0.3 | 12.4 | 6.8 | 2.52 | 3.18 | 0.07 | |
| 39 | 0.085 | 1.0 | 0.11 | 49.7 | 22.3 | 1.3 | 0.3 | 12.5 | 7.0 | 1.42 | 3.11 | 0.09 | |
| 40 | 0.084 | 1.0 | 0.11 | 47.7 | 22.4 | 1.3 | 0.3 | 12.5 | 7.1 | 1.41 | 5.01 | 0.09 | |
| 41 | 0.084 | 1.0 | 0.12 | 48.6 | 21.9 | 1.3 | 0.3 | 12.5 | 7.0 | 2.38 | 3.15 | 0.09 | |
| 42 | 0.078 | 1.1 | 0.11 | 50.3 | 22.4 | 1.2 | 0.3 | 12.5 | 7.1 | 0.98 | 3.02 | 0.10 | |
| 43 | 0.082 | 1.0 | 0.11 | 50.1 | 22.4 | 1.2 | 0.5 | 12.4 | 7.1 | 1.00 | 3.02 | 0.10 | |
| 44 | 0.084 | 1.0 | 0.16 | 49.1 | 22.5 | 1.1 | 0.4 | 12.5 | 7.1 | 1.16 | 3.98 | 0.06 | |
| 45 | 0.081 | 1.0 | 0.03 | 49.2 | 22.5 | 1.0 | 0.4 | 12.5 | 7.1 | 1.17 | 4.03 | 0.07 | |
| 46 | 0.08 | 1.5 | 0.19 | Bal. | 22.6 | 0.9 | 0.18 | 12.5 | 9.94 | 0.88 | 3.08 | 0.03 | 0.003 |
| 47 | 0.08 | 0.4 | 0.10 | Bal. | 22.8 | 1.05 | 0.25 | 12.5 | 7.55 | 1.27 | 3.13 | 0.03 | 0.004 |
| Comp. A | 0.080 | 1.5 | 0.13 | 53.8 | 22.2 | 1.2 | 0.3 | 12.5 | 9.8 | — | — | — | |
| Comp. B | 0.080 | 1.0 | — | 53.5 | 21.6 | 1.2 | 0.3 | 12.5 | 9.6 | — | — | — | |

As shown in Table 2, stress rupture tests were performed on alloys varying in composition of tantalum, tungsten and titanium. The stress rapture "CSRU") tests were conducted using strips having a thickness of 0.062 in. (0.158 cm) annealed at 2200° F. (1204° C.) for 5 minutes, followed by a water quench. All stress rupture testing data contained in this specification were tested in accordance with ASTM E-139. The SRU life and elongation at 1600° F./14.2 ksi (871° C./98 MPa) and 1700° F./9 ksi (927° C./76 MPa) were measured. Composition values in the following tables have been rounded off for ease of comparison.

TABLE 2

| | | | | | 1600° F./14.2 Ksi (871° C./98 MPa) | | 1700° F./9 Ksi (927° C./62 MPa) | |
|---|---|---|---|---|---|---|---|---|
| Alloy | Ta | W | Ti | Al | SRU life (hrs.) | Elong. (%) | SRU life (hrs.) | Elong. % |
| 2 | 1.0 | — | 1.0 | 1.3 | 136 | 25 | 47 | 51 |
| 4 | 1.0 | — | 0.5 | 1.3 | 82 | 42 | 39 | 62 |
| 9 | 1.0 | 3 | 1.0 | 1.3 | 240 | 15 | 76 | 38 |
| 15 | 0.5 | 3 | 0.3 | 1.3 | 33 | 70 | 47 | 78 |
| 16 | 0.5 | 5 | 0.3 | 1.3 | 36 | 73 | 48 | 58 |
| 19 | 1.0 | 3 | 0.3 | 1.3 | 34 | 78 | 52 | 70 |
| 20 | 1.0 | 5 | 0.3 | 1.3 | 50 | 58 | 63 | 51 |
| 21 | 1.0 | 3 | 0.1 | 0.6 | 51 | 78 | 63 | 58 |
| 22 | 1.0 | 5 | 0.1 | 0.6 | 41 | 97 | 77 | 77 |
| 27 | 2.0 | 3 | 0.3 | 1.3 | 130 | 20 | 35 | 59 |
| 28 | 2.0 | 5 | 0.3 | 1.3 | 107 | 71 | 47 | 39 |
| 29 | 2.4 | 3 | 0.3 | 1.3 | 82 | 39 | 67 | 61 |

TABLE 2-continued

| | | | | | 1600° F./14.2 Ksi (871° C./98 MPa) | | 1700° F./9 Ksi (927° C./62 MPa) | |
|---|---|---|---|---|---|---|---|---|
| Alloy | Ta | W | Ti | Al | SRU life (hrs.) | Elong. (%) | SRU life (hrs.) | Elong. % |
| 30 | 2.5 | 5 | 0.3 | 1.3 | 99 | 34 | 48 | 80 |
| 31 | 1.5 | — | 0.3 | 1.3 | 45 | 62 | 43 | 75 |
| 32 | 2.0 | — | 0.3 | 1.3 | 63 | 37 | 47 | 86 |
| 33 | 2.5 | — | 0.3 | 1.2 | 100 | 48 | 65 | 59 |

The stress rupture test results indicate that at 1600° F./14.2 ksi (871 ° C./98 MPa), the SRU life improves considerably for heats containing 2% tantalum or higher, with elongation at >30%. Additions of tungsten at 5% improves the SRU life at 1700° F./9 ksi (927° C./62 MPa). While increases in both titanium and tungsten impart improved stress rupture strength, this seems to be at the expense of impact strength. Table 3 shows impact strength results for heats of varying Ta, W and Ti composition. The impact strength tests were conducted using 0.625 in. (0.159 cm) diameter rods. The results are for annealed samples after exposure at indicated temperature for 24 hours. Also given are data for annealed samples held at 1400° F. (760° C.) for long term periods, i.e. 100 and 300 hours. The impact data of Table 3 and all other Tables of this specification originated from tests in accordance with ASTM E-23.

TABLE 3

| | | | | | IMPACT STRENGTH (24 hrs. at temp.) (Joules) | | | | Impact Strength [held at 1400° F. (760° C.)] (Joules) | |
|---|---|---|---|---|---|---|---|---|---|---|
| Alloy | Ta | W | Ti | Al | 1200° F. (649° C.) | 1400° F. (760° C.) | 1600° F. (871° C.) | 1800° F. (982° C.) | 100 hrs. | 300 hrs. |
| 6 | 1.0 | — | 1.0 | 1.3 | — | 12 | 12 | — | — | — |
| 8 | 1.0 | — | 0.5 | 1.3 | — | 19 | 19 | — | — | |
| 15 | 0.5 | 3 | 0.3 | 1.3 | 107 | 57 | 37 | 95 | — | — |
| 16 | 0.5 | 5 | 0.3 | 1.3 | 97 | — | 23 | 16 | — | — |
| 19 | 1.0 | 3 | 0.3 | 1.3 | 109 | 44 | 41 | 61 | — | — |
| 20 | 1.0 | 5 | 0.3 | 1.3 | 87 | 44 | 19 | 16 | — | — |
| 21 | 1.0 | 3 | 0.1 | 0.6 | 113 | 61 | 50 | 73 | 53 | 45 |
| 22 | 1.0 | 5 | 0.1 | 0.6 | 94 | 58 | 46 | 49 | 54 | 31 |
| 27 | 2.0 | 3 | 0.3 | 1.3 | 86 | 39 | 19 | 16 | — | — |

TABLE 3-continued

| Alloy | Ta | W | Ti | Al | IMPACT STRENGTH (24 hrs. at temp.) (Joules) 1200° F. (649° C.) | 1400° F. (760° C.) | 1600° F. (871° C.) | 1800° F. (982° C.) | Impact Strength [held at 1400° F. (760° C.)] (Joules) 100 hrs. | 300 hrs. |
|---|---|---|---|---|---|---|---|---|---|---|
| 28 | 2.0 | 5 | 0.3 | 1.3 | 37 | 29 | 5 | 10 | — | — |
| 29 | 2.4 | 3 | 0.3 | 1.3 | 73 | 33 | 10 | 16 | — | — |
| 30 | 2.5 | 5 | 0.3 | 1.3 | 68 | 23 | 4 | 5 | — | — |
| 31 | 1.5 | — | 0.3 | 1.3 | 106 | 38 | 63 | 80 | — | — |
| 32 | 2.0 | — | 0.3 | 1.3 | 102 | — | 52 | 83 | — | — |
| 33 | 2.5 | — | 0.3 | 1.2 | 126 | 42 | 49 | 84 | — | — |
| 36 | 1.5 | 3 | 0.3 | 0.3 | 231 | 82 | 103 | 83 | 91 | 82 |
| 39 | 1.5 | 3 | 0.3 | 1.3 | 188 | 41 | 73 | 90 | 49 | 38 |
| 40 | 1.5 | 5 | 0.3 | 1.3 | 124 | 46 | 58 | 114 | 41 | 20 |

From the above data, a balance among the Ta, W and Ti compositions, with consideration given to stress rupture strength, impact strength and non-technical concerns, such as the high cost of tantalum is required.

In addition to the above properties, the desired alloy must possess good fatigue strength. This property is most directly obtained by controlling grain size. A fine grain size, for example between ASTM #4 and 6.5 (89 and 38 μm), will impart good fatigue strength to the claimed alloy. Grains sizes as large as ASTM #2 (178 μm) provide further improved stress rapture strength, but tend to reduce fatigue strength to lower levels that are only acceptable for some applications.

Grain size control may be achieved by the addition of grain size control agents, such as small amounts of zirconium, silicon, titanium, nitrogen and about 0.08% carbon. In addition, anneal temperature is an important mechanism to control grain size. Table 4 shows the effect of varying anneal temperature on certain alloys.

The alloy samples were held at the indicated temperatures for 5 minutes followed by a water quench (except for comparison B alloy, which was annealed for 10 minutes). The water quench prevents adverse carbide precipitates from forming. The results indicate that annealing temperatures beyond 2200° F. (1204° C.) do not improve stress rupture strength appreciably at 1600° F./14.2 ksi (871 ° C./98 MPa), while at 1700° F./9 ksi (927° C./62 MPa), SRU life generally continues to increase at 2200° F. (1204° C.) and 2250° F. (1232° C.). With the increasing anneal temperatures comes an increase in grain size, along with a concomitant decrease in fatigue strength. Therefore, anneal temperatures of about 2200° F. (1204° C.) give the desired balance of good stress rupture life and good fatigue strength. In contrast, Comparison B alloy, which contains no tantalum and no tungsten, does exhibit increasing stress rupture life with increasing anneal temperature. However, the absence of the above-mentioned grain size control agents, namely silicon and zirconium, leads to uncontrolled grain growth and inadequate fatigue strength. Normally, the addition of silicon would have a negative effect on stress rupture life. However, the present inventors have discovered that by adding controlled amounts of tantalum and tungsten, stress rupture properties can be preserved in the presence of silicon.

TABLE 4

| Alloy | Anneal Temp (°F.) | Anneal Temp (°C.) | 1600° F./14.2 ksi (871° C./98 MPa) SRU LIFE (hrs.) | ELONG. % | 1700° F./9 ksi (927° C./62 MPa) SRU LIFE (hrs.) | ELONG. % | GRAIN SIZE (ASTM) | GRAIN SIZE METRIC |
|---|---|---|---|---|---|---|---|---|
| 21 | 2150 | 1177 | 36 | 83 | 42 | 61 | 7.0 | |
| | 2200 | 1204 | 51 | 78 | 62 | 59 | 5.5 | |
| | 2250 | 1248 | 45 | 65 | 101 | 64 | 4.5 | |
| 20 | 2150 | 1177 | 22 | 44 | 30 | 54 | 7.5 | |
| | 2200 | 1204 | 50 | 58 | 63 | 51 | 6.5 | |
| | 2250 | 1248 | 38 | 39 | 57 | 35 | 6.0 | |
| 27 | 2150 | 1177 | 45 | 37 | 29 | 86 | 7.0 | |
| | 2200 | 1204 | 130 | 20 | 35 | 58 | 6.0 | |
| | 2250 | 1248 | 94 | 35 | 53 | 66 | 5.0 | |
| 29 | 2150 | 1177 | 67 | 43 | 32 | 91 | 7.5 | |
| | 2200 | 1204 | 82 | 39 | 67 | 61 | 6.5 | |
| | 2250 | 1248 | 113 | 34 | 124 | 56 | 6.5 | |
| Comp B | 2100 | 1149 | — | — | 19 | 62 | 6.5 | |
| | 2150 | 1177 | — | — | 97 | 43 | 3 | |
| | 2175 | 1190 | — | — | 63 | 29 | >1 | |
| | 2200 | 1204 | — | — | 97 | 23 | >1 | |

In order to ascertain the effect of nitrogen and carbon as grain controlling agents and their subsequent effect on the stress rupture properties, four heats containing 1.5% tantalum were made with two levels of carbon (0.04 and 0.08%) and two levels of nitrogen (0 and 0.04%). (Also, alloys 1–10 and 15–33 contain about 0.03–0.05% nitrogen.) The samples were held at the indicated temperatures for 5 minutes, followed by a water quench. The anneal temperatures were 2100° F.(1149° C.), 2150° F.(1177° C.) and 2200° F. (1204° C.). The stress rupture results at 1600° F./14.2 ksi (871° C./98 MPa) and 1700° F./9 ksi (927° C./62 MPa) and ASTM grain sizes after the various anneals are shown in Table 5. The results indicate that nitrogen-containing heats show lower stress rupture lives because of the finer grain sizes, and that the effect is more pronounced at 1600° F./14.2 ksi (871° C./98 MPa). Good stress rupture properties can be obtained at a 1.5% tantalum level with sufficient grain size control agents such as small amounts of zirconium and 0.08% carbon. Since zirconium may have a negative impact upon weldability, zirconium is most advantageously limited to less than 0.1 weight percent. Therefore, it appears that nitrogen is not critical as a grain size controlling agent.

TABLE 5

| Alloy | C | N | Anneal Temp. °F. | Anneal Temp °C. | 1600° F./14.2 Ksi (871° C./98 MPa) SRU Life (hrs.) | Elong. % | 1700° F./9 Ksi 927° C./62 MPa) SRU Life (hrs.) | Elong. % | ASTM Grain Size | Metric Grain Size |
|---|---|---|---|---|---|---|---|---|---|---|
| 11 | 0.08 | 0.04 | 2100 | 1149 | 14 | 96 | 15 | 74 | 8.0 | |
| | | | 2150 | 1177 | 25 | 49 | 34 | 71 | 6.0 | |
| | | | 2200 | 1204 | 32 | 59 | 46 | 56 | 4.0 | |
| 12 | 0.08 | — | 2100 | 1149 | 28 | 68 | 9 | 66 | 7.0 | |
| | | | 2150 | 1177 | 61 | 43 | 35 | 88 | 6.0 | |
| | | | 2200 | 1204 | 58 | 43 | 64 | 41 | 4.5 | |
| 13 | 0.04 | 0.04 | 2100 | 1149 | 12 | 66 | 12 | 82 | 6.5 | |
| | | | 2150 | 1177 | 32 | 50 | 36 | 64 | 6.0 | |
| | | | 2200 | 1204 | 39 | 72 | 52 | 76 | 5.0 | |
| 14 | 0.04 | — | 2100 | 1149 | 45 | 56 | 21 | 56 | 5.5 | |
| | | | 2150 | 1177 | 76 | 36 | 32 | 53 | 4.0 | |
| | | | 2200 | 1204 | 69 | 21 | 31 | 56 | 3.0 | |

In addition to the above-mentioned constituents, aluminum and titanium can also be varied to achieve improved properties for high temperature applications. Table 5 shows the effect of Al and Ti concentration on SRU life and elongation. Generally, alloys 21 and 22 (having lower Al and Ti concentrations) show increased SRU life. More significant, however, is the increase in impact strength obtained for these alloys when compared, respectively, to alloys 19 and 20, as shown in Table 3.

In general, with regard to high temperature strength properties, the stress rupture results indicate that good stress rupture lives (>50 hours) can be obtained with about 1 to 1.5% tantalum, 3 to 5% tungsten and 7 to 10% molybdenum. However, increasing tungsten from 3 to 5% decreases impact strength after long exposure at 1400° F. (760° C.) (Compare alloys 21 and 22, and alloys 40 and 44). Also, increasing tantalum from 1 to 1.5% appears to decrease the impact strength at 1.3% Al. Good impact strength can be obtained with higher tantalum provided lower aluminum is used, as seen by comparing alloys 36 and 40. If the tantalum level is increased to above 2%, as in alloy 33 (2.4% Ta), stress rupture lives close to 100 hours at 1600° F./14.2 ksi (871° C./98 MPa) can be obtained. However, impact strength will decrease after exposure to intermediate temperatures due to the formation of mu phase. Also, the cost of the alloy is likely to increase because of the high cost of tantalum.

It has been further discovered that excess molybdenum (at least 10% Mo) has an adverse effect on impact strength after prolonged exposure to elevated temperature. For example, Table 6 provides impact strength after exposure to 1600° F. (871° C.) for extended times.

TABLE 6

| Exposure time at 1600° F. (871° C.) Hours | Impact Strength alloy 46 (ft lbs) | (Joules) | Impact Strength alloy 47 (ft lbs) | (Joules) |
|---|---|---|---|---|
| 100 | 19 | 26 | 34 | 46 |
| 300 | 8 | 11 | 40 | 54 |
| 1000 | 4 | 5 | 40 | 54 |

The results in Table 6 indicate that the impact strength decreases with time for an alloy containing about 10% molybdenum. It is therefore recommended that composition for the alloy be restricted to 5 to 9% molybdenum. Advantageously, molybdenum is restricted to 8.5%. Most advantageously, molybdenum is restricted to 8% to limit deterioration of impact properties at 871° C.

FIG. 1 compares SRU of age resistant alloy 47 to commercial alloy 617. Samples of alloy 47 were annealed at 2150° F. (1177° C.) for 1.5 hours plus (1hour-/inch plate thickness) and water quenched. Presently, it is believed that a 2150° F. (1177° C.) heat treatment followed by a water quench provides the optimum properties for alloys having 9% or less molybdenum. The alloy of the invention most advantageously does not contain any mu phase after heat treatment. At temperatures of 1600° F. (871° C.) and greater the alloy of the invention increased cycles to failure by at least two orders of magnitude.

In order to simulate a commercial braze cycle used for joining various gas turbine components, the following experiments were conducted. Selected samples were heated to 2175° F. (1191° C.) and held at temperature for 20 minutes and then cooled to 1700° F. (927° C.) at the rate of 40° F./min (22.2° C./rain) and then air cooled. In some cases the cycle was repeated 3 times. Then the samples were stress rupture tested at 1700° F./9ksi (927° C./62 MPa). The results are shown in Table 7. The results indicate that samples of Alloys 21 and 22 maintain their stress rupture strength after the braze cycles.

TABLE 7

| Alloy | Ta | W | Ti | Al | 1 Cycle SRU Life (Hrs.) | Elong. Elong. % | 3 Cycles SRU Life (Hrs.) | Elong. |
|---|---|---|---|---|---|---|---|---|
| 21 | 1.0 | 3.0 | 0.1 | 0.6 | 47 | 66 | 50 | 57 |
| 22 | 1.0 | 5.0 | 0.1 | 0.6 | — | — | 37 | 48 |
| 36 | 1.5 | 3.0 | 0.3 | 0.3 | 29 | 82 | 45 | 25 |
| 39 | 1.5 | 3.0 | 0.3 | 1.3 | 17 | 34 | 23 | 35 |
| 40 | 1.5 | 5.0 | 0.3 | 1.3 | 14 | 91 | 12 | 39 |

Also important are corrosion properties. The corrosion performance of samples are shown in Table 8 in the form of mass change per unit area of cross section. The data are presented for isothermal oxidation at 1100° C. ("OX2"), cyclic oxidation at 1093° C. ("Cyc. OX"), carburization tests in $H_2$-1% $CH_4$ ("C1") and $H_2$-5.5% $CH_4$-4.5% $CO_2$("C2") at 1000° C. Cyclic oxidation involves heating the samples to the temperature for 15 minutes and cooling in air for 5 minutes. The cyclic oxidation data reported are for about 1500 cycles and the exposure times for oxidation and carburization tests were about 1000 hours. The data are described in terms of the effect of the individual elements aluminum, titanium, silicon, tantalum, molybdenum and tungsten in providing resistance to the alloy against specific environments. Time of exposure was about 1000 hours, except for cyclic oxidation, which was conducted up to about 1500 cycles.

TABLE 8

| Alloy # | Al | Ti | Si | Mo | Ta | W | Zr | Cyc. OX. 1093° C. mg/cm² | OX2 1100° C. mg/cm² | C1 1000° C. mg/cm² | C2 1000° C. mg/cm² |
|---|---|---|---|---|---|---|---|---|---|---|---|
| Comp A | 1.2 | 0.3 | 0.13 | 9.8 | — | — | — | −4 | −8.90 | 15 | 6 |
| 34 | 1.3 | 0.3 | 0.17 | 10 | — | — | 0.04 | +3 | — | — | — |
| 19 | 1.3 | 0.3 | — | 10 | 1 | 3 | 0.09 | — | −2.00 | 10 | 5 |
| 21 | 0.7 | 0.1 | — | 10 | 1 | 3 | 0.09 | −30 | −0.75 | 24 | 25 |
| 22 | 0.6 | 0.1 | — | 10 | 1 | 5 | 0.09 | −33 | −0.03 | 23 | 33 |
| 35 | 0.3 | 0.3 | — | 5 | 1.5 | 3 | 0.09 | — | −8.50 | 21 | 35 |
| 36 | 0.3 | 0.3 | — | 7 | 1.5 | 3 | 0.08 | −131 | −2.40 | 19 | 36 |
| 37 | 0.3 | 0.3 | — | 7 | 1.5 | 5 | 0.08 | — | −5.60 | 20 | — |
| 38 | 1.3 | 0.3 | — | 7 | 2.5 | 3 | 0.08 | — | −0.90 | 19 | 37 |
| 39 | 1.3 | 0.3 | 0.12 | 7 | 1.5 | 3 | 0.09 | −1 | −7.60 | 8 | 10 |
| 40 | 1.3 | 0.3 | 0.11 | 7 | 1.5 | 5 | 0.09 | −1 | −7.30 | 8 | 19 |
| 41 | 1.3 | 0.3 | 0.12 | 7 | 2.4 | 3 | 0,09 | — | −6.60 | 8 | 12 |
| 42 | 1.2 | 0.3 | 0.11 | 7 | 1 | 3 | 0.10 | — | −2.60 | 8 | 6 |
| 43 | 1.2 | 0.5 | 0.11 | 7 | 1 | 3 | 0.10 | −2 | −6.90 | 8 | 16 |
| 44 | 1.0 | 0.40 | 0.16 | 7 | 1 | 4 | 0,06 | — | — | 7 | 13 |
| 45 | 1.0 | 0.40 | 0.03 | 7 | 1 | 4 | 0.06 | — | — | 18 | 15 |

The data in Table 8 indicate that while low aluminum is not detrimental to high temperature oxidation, the cyclic oxidation resistance is considerably reduced for lower aluminum containing heats (compare alloys 21 and 22 against alloy 40, and these three alloys venus the rest of the heats containing about 1.2–1.3% Al). Higher aluminum also increases resistance to the $H_2$-1% $CH_4$ ("C1") carburizing environment (compare alloys 19 and 21). Small amounts of zirconium appear to improve cyclic oxidation resistance over alloy 617 (alloy 34 vs. comparison alloy A.)

Higher titanium (0.5% vs. 0.3%) appears to reduce high temperature oxidation resistance and resistance to $H_2$-1% $CH_4$, but does not impair oxidizing carburization resistance (alloy 43 vs. alloy 42). Higher silicon improves oxidizing carburization resistance (alloy 44 vs. alloy 45). Also several alloys that did not have an intentional addition of silicon show mass gain of 10 to 20 mg/cm² where as the heats containing silicon show a mass gain of less than 10 mg/cm² in an oxidizing carburization environment ($H_2$-5.5% $CH_4$-4.5% $CO_2$). Increasing tantalum from 1.5% to 2.5% does not appear to impair high temperature oxidation resistance (alloy 38 vs. alloy 36). Lowering of the molybdenum below 7% reduces high temperature oxidation resistance (alloy 35 vs. alloy 40). Increasing tungsten from 3% (alloy 36 vs. alloy 38) but did not reduce the resistance to high temperature oxidation in another case (alloy 21 vs. alloy 22). However, higher tungsten decreased the resistance to reducing carburization environment ($H_2$-1% $CH_4$) in both cases mentioned above.

Figure 2:
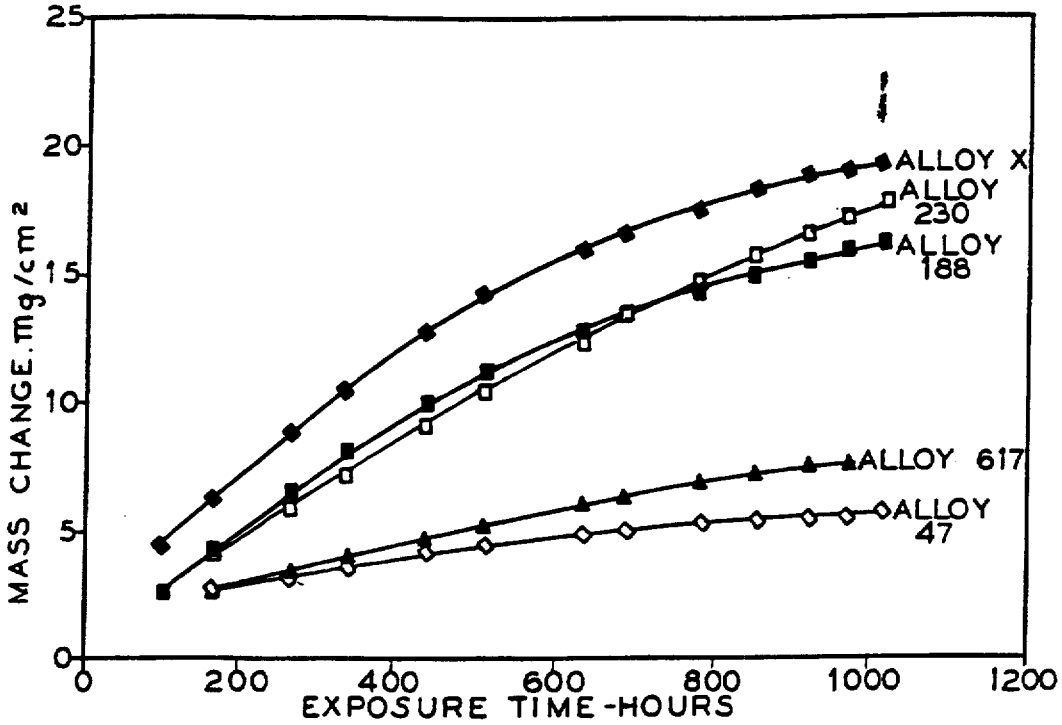
FIG. 2 compares mass change of alloys of the invention to mass change of commercial alloys X, 188, 230 and 617 in a hydrogen/5.5% methane/4.5% carbon dioxide atmosphere at 1000° C.
Figure 3:
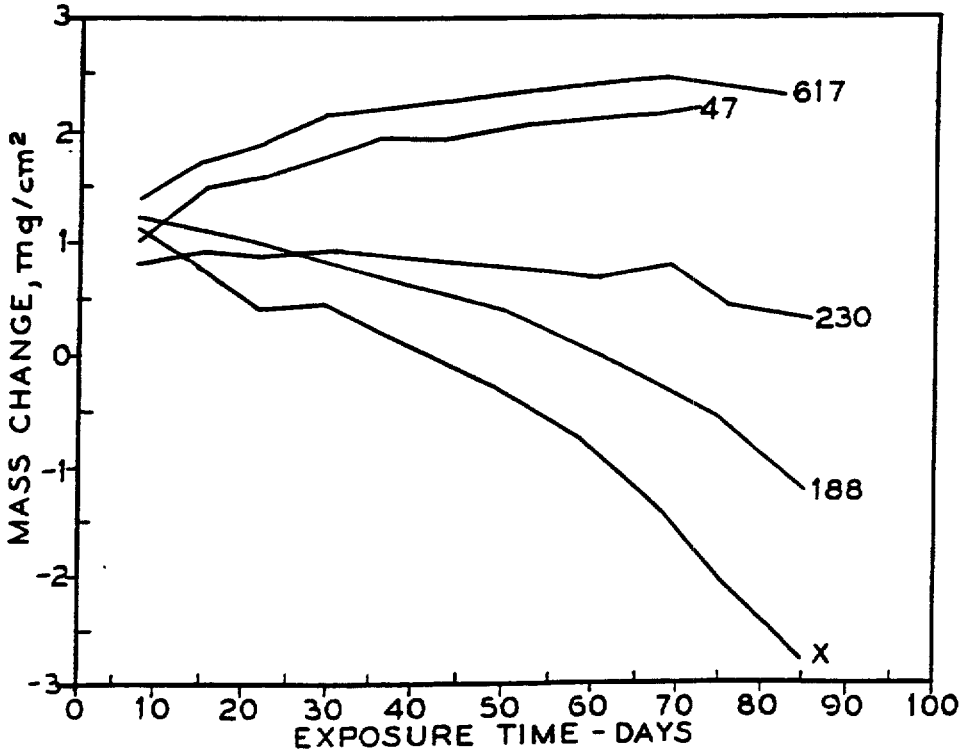
FIG. 3 compares mass change of alloy of the invention to mass change of commercial alloys X, 188, 230 and 617 in an air/5% $H_2O$ vapor atmosphere.

FIGS. 2 and 3 illustrate that in comparison to alloy 617, alloy 47 provides similar to slightly improved corrosion resistance. However, the alloy of the invention significantly improves corrosion resistance in a hydrogen/5.5% methane/4.5 % carbon dioxide atmosphere and in an air/5 % $H_2O$ vapor atmosphere in comparison to alloys X, 188 and 230.

To summarize the corrosion results, an aim of 0.8% aluminum is needed to provide good cyclic oxidation and carburization resistance. A certain amount of silicon is needed to provide resistance against the oxidizing carburization environment. Titanium, although it imparts resistance against oxidizing carburization environment, impairs high temperature oxidation resistance. Small amounts of zirconium can be added to impart cyclic oxidation resistance and compensate for reduced aluminum necessary to improve the impact strength. Based on the mechanical properties and corrosion studies, the following composition would provide an alloy with the desired characteristics.

TABLE 9

| ELEMENT | BROAD | INTERMEDIATE | NARROW | NOMINAL |
|---|---|---|---|---|
| Carbon | 0.04–0.15 | 0.04–0.15 | 0.04–0.15 | 0.085 |
| Iron | 0–8 | 0–6 | 0–4 | 1.0 |
| Chromium | 18–25 | 19–24 | 20–23 | 21.8 |
| Cobalt | 10–15 | 10–15 | 10–15 | 12.5 |
| Molybdenum | 5–9 | 5–8.5 | 5–8 | 7.0 |
| Aluminum | 0.7–1.5 | 0.7–1.5 | 0.7–1.5 | 1.0 |
| Tungsten | 0–5 | 1–5 | 2–5 | 3.0 |
| Titanium | 0–0.5 | 0–0.5 | 0.02–0.5 | 0.1 |
| Tantalum | 0.7–2.5 | 0.7–2.2 | 0.7–2.0 | 1.3 |
| Manganese | 0–1.0 | 0–1 | 0–1 | — |
| Silicon | 0.05–0.75 | 0.05–0.6 | 0.05–0.5 | 0.2 |
| Zirconium | 0.01–0.05 | 0.01–0.05 | 0.01–0.05 | 0.06 |
| Boron | 0–0.05 | 0–0.02 | 0.0001–0.01 | 0.003 |
| Nickel - Incidental Impurities | Balance | Balance | Balance | Balance |

Other residual elements may be present as follows: up to about 0.05% Mg and not more than 1% Cu. The above composition is expected to provide good stress rupture strength with excellent grain size control. The oxidation and carburization resistance of the modified alloy should be equivalent to alloy 617. Reheat annealing can be done at 2150° F. (1177° C.); however, final anneal should be done at 2200° F. (1204° C.) or 2150° F. (1177° C.) to obtain good stress rupture properties.

Additional tensile test results have provided improvements in yield and tensile properties for alloys containing less than 9% or less molybdenum. Furthermore, initial creep data have indicated an improvement over alloy 617. Large scale ingots may be treated by electroslag remelting (ESR). When ESR is used the melting rate should be adjusted to a rate that does not produce a banded microstructure. A banded microstructure may further decrease impact strength. Boron may optionally be added to wrought alloys for improved workability.

While in accordance with the provisions of the statute, there is illustrated and described herein specific embodiments of the invention. Those skilled in the art will understand that changes may be made in the form of the invention covered by the claims and the certain features of the invention may sometimes be used to advantage without a corresponding use of the other features.

What is claimed is:

1. An alloy with superior high temperature strength properties, grain size control and corrosion resistance, consisting essentially of, by weight percent, about:

| | |
|---|---|
| Carbon | 0.04–0.15 |
| Iron | 0–8 |
| Chromium | 18–25 |
| Cobalt | 10–15 |
| Molybdenum | 7–8.5 |
| Aluminum | 0.7–1.5 |
| Tungsten | 0–5 |
| Titanium | 0–0.5 |
| Tantalum | 0.7–2.2 |
| Manganese | 0–1 |
| Silicon | 0.05–0.75 |
| Zirconium | 0.01–0.1 |
| Boron | 0–0.05 |
| Nickel + inevitable impurities | balance. |

2. The alloy of claim 1 wherein said ahoy contains by weight percent 0 to 6 iron and 19 to 24 chromium.

3. The ahoy of claim 1 wherein said alloy contains by weight percent 1 to 5 tungsten.

4. The alloy of claim 1 wherein said alloy contains by weight percent 0.7 to 2.0 tantalum.

5. The alloy of claim 1 wherein said alloy has a stress rupture life greater than 50 hours at 871° C./98 MPa and 927° C./62 MPa and a grain size of 38 to 89 μm.

6. An alloy with superior high temperature strength properties, grain size control and corrosion resistance, consisting essentially of, by weight percent, about:

| | |
|---|---|
| Carbon | 0.04–0.15 |
| Iron | 0–6 |
| Chromium | 19–24 |
| Cobalt | 10–15 |
| Molybdenum | 7–8.0 |
| Aluminum | 0.7–1.5 |
| Tungsten | 1–5 |
| Titanium | 0–0.5 |
| Tantalum | 0.7–2.2 |
| Manganese | 0–1 |
| Silicon | 0.05–0.6 |
| Zirconium | 0.01–0.1 |
| Boron | 0–0.02 |
| Nickel + inevitable impurities | balance |

7. The alloy of claim 6 wherein said alloy contains by weight percent to 4 iron and 20 to 23 chromium.

8. The alloy of claim 6 wherein said alloy contains by weight percent 2 to 5 tungsten.

9. The alloy of claim 6 wherein said alloy contains by weight percent 0.7 to 2.0 tantalum.

10. The alloy of claim 6 wherein said alloy has a stress rupture life of greater than 50 hours at 871° C./98 MPa and 927° C./62 MPa and a grain size of 38 to 89 μm.

11. An alloy with superior high temperature strength properties, grain size control and corrosion resistance, consisting essentially of, by weight percent, about:

| | |
|---|---|
| Carbon | 0.04–0.15 |
| Iron | 0–4 |
| Chromium | 20–23 |
| Cobalt | 10–15 |
| Molybdenum | 7–8 |
| Aluminum | 0.7–1.5 |
| Tungsten | 2–5 |
| Titanium | 0.05–0.5 |
| Tantalum | 0.7–2.0 |
| Manganese | 0–1 |
| Silicon | 0.05–0.5 |
| Zirconium | 0.01–0.1 |
| Boron | 0.0001–0.01 |
| Nickel + inevitable impurities | balance |

12. The alloy of claim 11 wherein said alloy has a stress rupture life greater than 50 hours at 871° C./98 MPa and 927° C./62 MPa and a grain size of 38 to 89 μm.

13. The alloy of claim 11 having the nominal composition of about 0.085 carbon, 1.0 iron, 21.8 chromium, 1.0 aluminum, 0.2 silicon, 0.1 titanium, 12.5 cobalt, 7.0 molybdenum, 1.3 tantalum, 0.06 zirconium, 0.003 boron, 3 tungsten and balance nickel.

14. The alloy of claim 13 wherein said alloy has a stress rupture iife greater than 50 hours at 871° C. 198MPa and 927° C. 162 MPa and a grain size of 38 to 89 μm.

* * * * *